US008113270B2

(12) United States Patent
Rios et al.

(10) Patent No.: US 8,113,270 B2
(45) Date of Patent: Feb. 14, 2012

(54) TUBE INSERT AND BI-FLOW ARRANGEMENT FOR A HEADER OF A HEAT PUMP

(75) Inventors: Arturo Rios, Avon, IN (US); Allen C. Kirkwood, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 1257 days.

(21) Appl. No.: 11/794,776

(22) PCT Filed: Dec. 22, 2005

(86) PCT No.: PCT/US2005/046604

§ 371 (c)(1), (2), (4) Date: Jul. 5, 2007

(87) PCT Pub. No.: WO2006/083426

PCT Pub. Date: Aug. 10, 2006

(65) Prior Publication Data

US 2008/0093051 A1 Apr. 24, 2008

Related U.S. Application Data

(60) Provisional application No. 60/649,283, filed on Feb. 2, 2005.

(51) Int. Cl.

| | |
|---|---|
| ***G05D 23/00*** | (2006.01) |
| ***F28F 27/02*** | (2006.01) |
| ***F25B 29/00*** | (2006.01) |

(52) U.S. Cl. ..... 165/287; 165/61; 165/97; 165/174; 165/175; 62/238.7; 62/324.6; 62/527; 62/528; 29/890.035

(58) Field of Classification Search ..... 165/61, 165/96, 97, 100, 103, 173, 174, 175, 176, 165/241, 287; 62/238.6, 238.7, 527, 528, 62/324.6; 236/92 B; 29/890.035
See application file for complete search history.

(56) References Cited

U.S. PATENT DOCUMENTS

| | | | | |
|---|---|---|---|---|
| 2,097,602 | A | | 11/1937 | Rohlin |
| 2,642,724 | A | * | 6/1953 | Carter ..... 236/92 B |
| 2,694,296 | A | * | 11/1954 | Prosek et al. ..... 62/324.6 |
| 3,976,128 | A | | 8/1976 | Patel et al. |
| 4,261,177 | A | | 4/1981 | Sterlini |
| 4,277,953 | A | | 7/1981 | Kramer |
| 4,309,987 | A | | 1/1982 | Higgins, Jr. |

(Continued)

FOREIGN PATENT DOCUMENTS

| | | |
|---|---|---|
| GB | 2250336 | 6/1992 |

(Continued)

*Primary Examiner* — Ljiljana Ciric
(74) *Attorney, Agent, or Firm* — Cantor Colburn LLP

(57) ABSTRACT

An inlet header (22) of a microchannel heat pump heat exchanger has a tube (34) disposed therein and extending substantially the length of the inlet header (22), with the tube (34) having a plurality of openings (36) therein. During cooling mode operation, refrigerant is caused to flow into an open end of the tube (34) and along its length to thereby flow from the plurality of openings (36) into the inlet header (22) prior to entering the microchannels (24) to thereby provide a uniform flow of two-phase refrigerant thereto. A bi-flow expansion device (41) placed at the inlet end of the tube (34) allows for the expansion of liquid refrigerant into the tube (34) during periods in which the heat exchanger operates as an evaporator and allows the refrigerant to flow directly from the header (22) and around the tube (34) during periods in which the heat exchanger operates as a condenser coil.

16 Claims, 4 Drawing Sheets

U.S. PATENT DOCUMENTS 4,382,468 A 5/1983 Hastwell
4,524,823 A 6/1985 Hummel et al.
4,593,539 A 6/1986 Humpolik et al.
5,085,058 A * 2/1992 Aaron et al. ..... 62/324.6
5,103,559 A 4/1992 Hoffmuller
5,341,656 A 8/1994 Rust, Jr. et al.
5,343,620 A 9/1994 Velluet
5,523,607 A 6/1996 Zambrano
5,581,883 A * 12/1996 Matambo et al. ..... 29/890.035
5,651,268 A 7/1997 Aikawa et al.
5,704,221 A 1/1998 Lego
5,706,670 A * 1/1998 Voorhis ..... 62/324.6
5,715,704 A * 2/1998 Cholkeri et al. ..... 62/527
5,715,862 A * 2/1998 Palmer ..... 62/324.6
5,743,111 A 4/1998 Sasaki et al.
5,765,393 A 6/1998 Shlak et al.
5,806,586 A 9/1998 Osthues et al.
5,813,244 A * 9/1998 Palmer ..... 62/324.6
5,881,456 A 3/1999 Bergins et al.
5,901,785 A 5/1999 Chiba et al.
5,931,220 A 8/1999 Ueda et al.
5,941,303 A 8/1999 Gowan et al.
5,984,198 A * 11/1999 Bennett et al. ..... 62/238.6
6,053,243 A 4/2000 Kato et al.
6,158,503 A * 12/2000 Gille et al. ..... 165/174
6,179,051 B1 1/2001 Ayub
6,199,399 B1 * 3/2001 Voorhis ..... 62/324.6
6,286,590 B1 9/2001 Park
6,394,176 B1 5/2002 Marsais
6,430,945 B1 8/2002 Haussmann
6,470,703 B2 10/2002 Wada et al.
6,484,797 B2 11/2002 Saito et al.
6,688,137 B1 2/2004 Gupte
6,688,138 B2 2/2004 DiFlora
6,729,386 B1 5/2004 Sather
6,796,374 B2 9/2004 Rong
6,814,136 B2 11/2004 Yi et al.
6,988,539 B2 1/2006 Kato et al.
7,021,371 B2 4/2006 Saito et al.
7,143,605 B2 12/2006 Rohrer et al.
7,302,811 B2 * 12/2007 Nungesser et al. ..... 62/527
2002/0174978 A1 11/2002 Beddome et al.
2003/0010483 A1 1/2003 Ikezaki et al.
2003/0116310 A1 6/2003 Wittmann et al.

FOREIGN PATENT DOCUMENTS

JP 61147071 A 7/1986
JP 4295599 10/1992
JP 6159983 6/1994
JP 2000179987 A 6/2000
JP 2001304775 10/2001
WO WO-9414021 6/1994

* cited by examiner

TUBE INSERT AND BI-FLOW ARRANGEMENT FOR A HEADER OF A HEAT PUMP

TECHNICAL FIELD

This invention relates generally to heat exchangers and, more particularly, to microchannel heat exchangers for use with two-phase refrigerant in a heat pump.

BACKGROUND OF THE INVENTION

Microchannel heat exchangers are currently designed in a parallel flow configuration, wherein there is a long inlet header that extends the length of the core and feeds multiple parallel tubes that then feed into an outlet header. The diameter of the headers must be larger than the major axis of the microchannel tube. When this parallel flow microchannel heat exchanger operates as an evaporator, two-phase refrigerant is being fed into the inlet header. Since this two-phase refrigerant is a mixture of vapor and liquid, it tends to separate in the inlet header leading to maldistribution within the evaporator (i.e. some tubes are fed mostly vapor instead of a balanced mixture of vapor and liquid), which has a negative effect on the cooling capacity and efficiency of the air conditioner. Because the performance is compromised in this manner, additional surface must be added to the evaporator to match the capacity and efficiency of a comparable round tube, plate fin evaporator. This increases the cost as well.

Typically, an inlet header is only fed from one side in what is referred to as a direct feed approach. Such a direct feed approach causes two-phase refrigerant to flow through the entire length of the header, with the vapor and liquid tending to separate out such that some tubes get mostly vapor and others get mostly liquid, thereby resulting in dry surfaces and poor utilization of the heat exchanger.

An alternative to the direct feed approach is to use a distributor leading to multiple feeder tubes that feed into baffled sections of the header. This method results in considerable additional expense over the direct feed method as additional hardware such as the distributor/feeder tube assembly must be added as well as the baffles in the header.

When particular structures are added to heat exchangers in order to promote uniform flow from the inlet manifold to the microchannels during cooling mode operation, those same structures may interfere with refrigerant flowing in the opposite direction during operation in the heating mode.

DISCLOSURE OF THE INVENTION

In accordance with one aspect of the invention, the distribution of two-phase refrigerant to the multiple channels of a microchannel heat exchanger in a heat pump can be made more uniform when operating in the cooling mode by the placement of a perforated tube within the inlet header, with the tube being fed refrigerant at its one end and extending substantially the length of the header. The perforations act as distributors to conduct the flow of two-phase refrigerant from the insert tube into the inlet manifold. In this manner, each region of the inlet header will be fed a well-mixed, uniform flow of two-phase refrigerant that then enters the individual channels in a uniform manner. A bi-flow expansion device is provided at the inlet to the perforated tube insert such that during cooling mode operation the refrigerate expansion occurs immediately before entering the perforated tube and during heating mode operation, the expansion device allows the refrigerant to bypass the perforated tube such that the refrigerant flows directly from the manifold to the expansion device.

In accordance with another aspect of the invention, the size/shape of the perforations in the tube can be selectively formed in order to obtain optimal distribution. In general, the size of the perforations increases toward the downstream end of the tube.

In accordance with another aspect of the invention, the number of perforations in the tube is made equal to the number of channels in the microchannel heat exchanger. That is, the perforations are so placed that there is a perforation located in longitudinal alignment with each of the channels. They may be either axially aligned or radially offset from the axes of their respective channels.

In the drawings as hereinafter described, a preferred embodiment is depicted; however, various other modifications and alternate constructions can be made thereto without departing from the true spirit and scope of the invention.

DETAILED DESCRIPTION OF THE INVENTION

Figure 1:
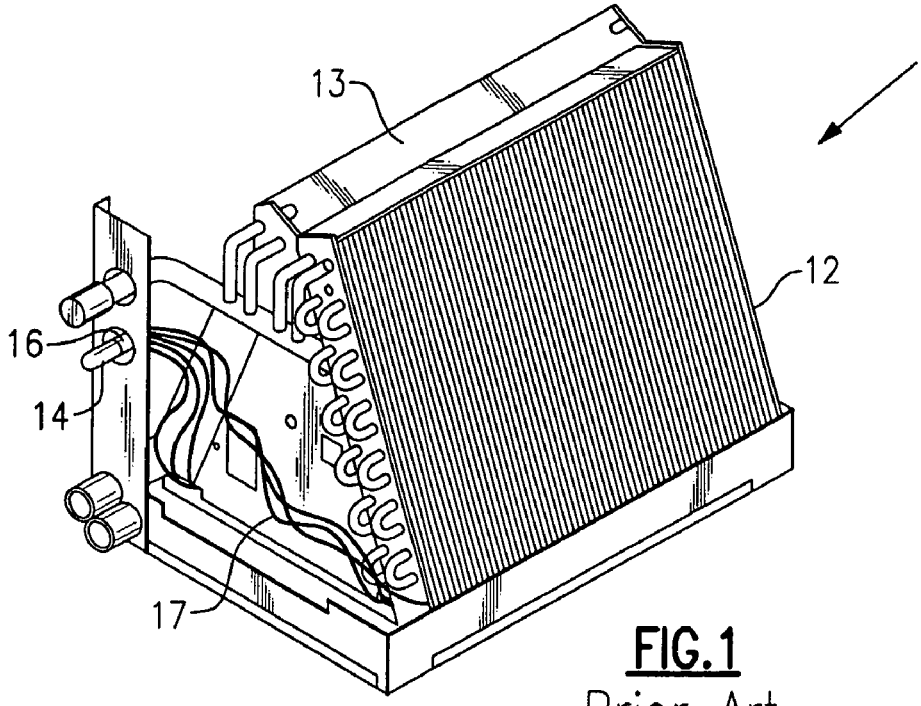
FIG.1 Prior Art
FIG. 1 is a perspective view of a conventional A-coil in accordance with the prior art.

Referring to FIG. 1, there is shown a conventional A-coil having a pair of coil slabs 12 and 13 with each having a plurality of refrigerant carrying tubes passing through a plurality of fins which, in turn, are adapted to have air passed therethrough by way of a blower or fan.

In practice, liquid refrigerant from a condenser (not shown) passes to an expansion device 14, with the resulting two-phase refrigerant then passing to a distributor 16 and then to a plurality of connecting lines 17 that carry the two-phase refrigerant into the various circuits of tubes. As the air passes through the slabs 12 and 13 is cooled, the refrigerant is boiled off with the refrigerant vapor then passing to a compressor and then back to the condenser.

Figure 2:
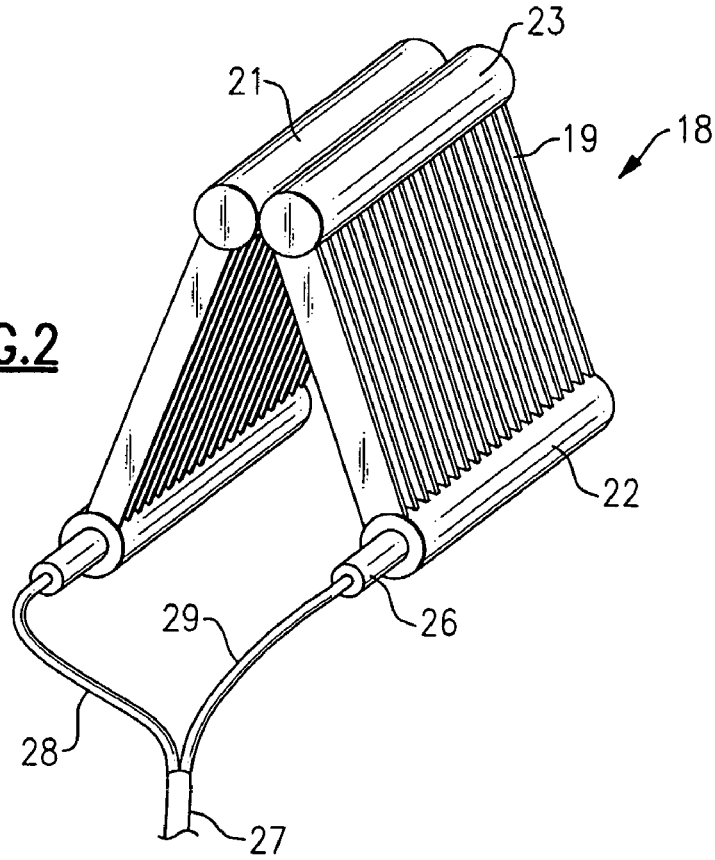
FIG. 2 is a perspective view of a microchannel A-coil in accordance with one embodiment of the invention.

FIG. 2 shows a microchannel A-coil 18 in accordance with one aspect of the invention, with the A-coil 18 being formed of a pair of microchannel evaporator coils 19 and 21. Each of the microchannel evaporator coils 19 and 21 have an inlet header 22, an outlet header 23 and a plurality of microchannels 24 fluidly interconnected therebetween.

At the entrance of each inlet header 22 is an expansion device 26. The liquid refrigerant is introduced from the condenser along line 27 and splits into lines 28 and 29 to feed the expansion devices 26 which, in turn, pass the two-phase refrigerant directly into the inlet headers 22. The two-phase refrigerant then passes into the individual microchannels 24 and flows to the respective outlet manifolds 21 and 23, after which the refrigerant vapor passes to the compressor.

Figure 3:
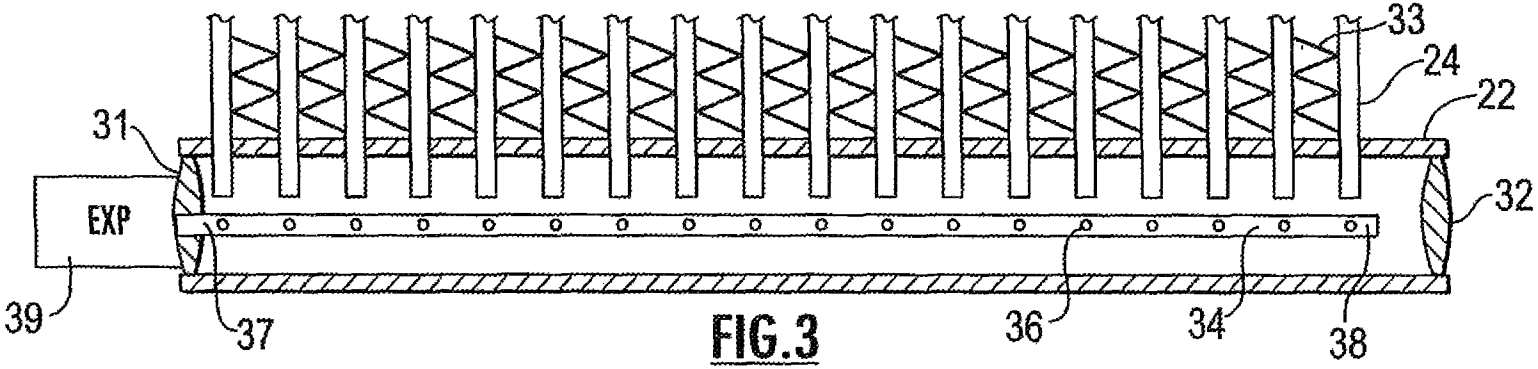
FIG. 3 is a longitudinal cross-sectional view of an inlet header thereof.

As will be seen in FIG. 3, the inlet header 22 is a hollow cylinder having end walls 31 and 32 and having the plurality of microchannels 24 extending outwardly on one side thereof for conducting the flow of two-phase refrigerant toward the outlet header 23. Fins 33 are placed between adjacent microchannels 24 for enhancing the heat transfer characteristics of the coils.

Figure 5:
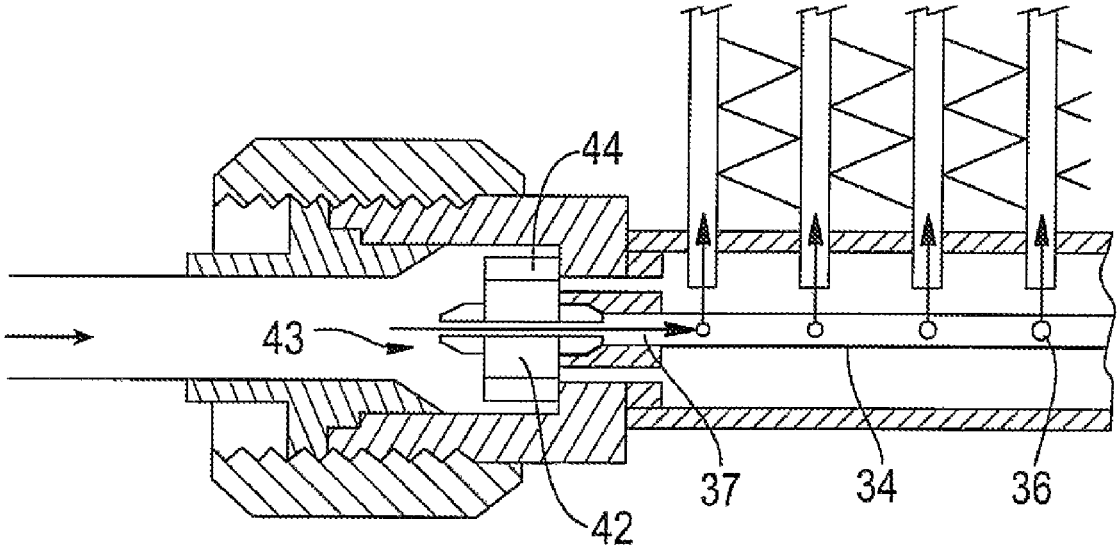
FIG. 5 is a cross-sectional view of the expansion valve portion thereof as shown in the cooling mode operation.
Figure 6:
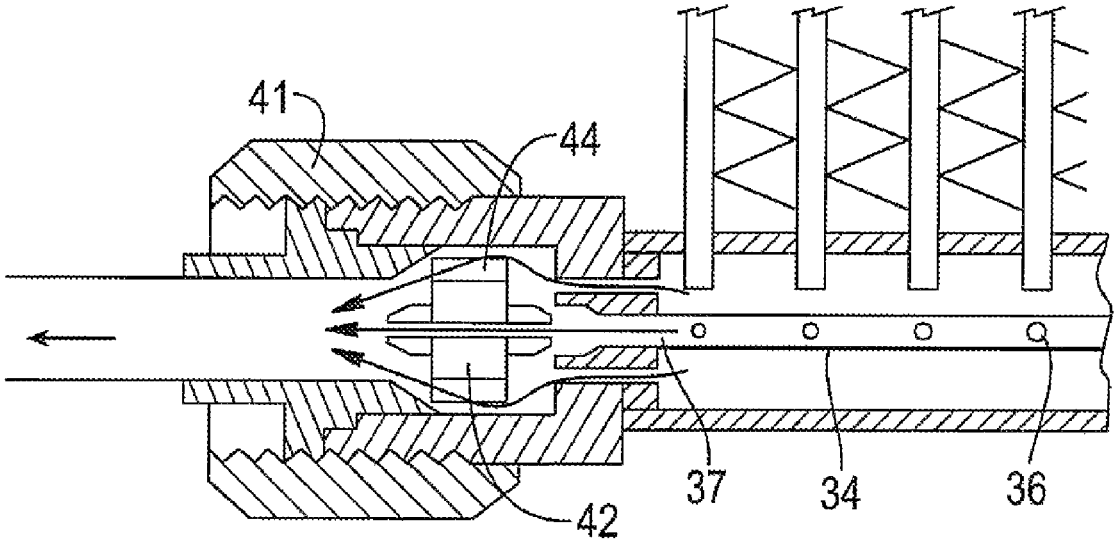
FIG. 6 is a cross-sectional view thereof as shown in the heating mode operation.

The tube 34 passes through the end wall 31 and extends substantially the length of the inlet header 22 from an inlet end 37 to a downstream end 38 as shown. The tube 34 may be concentrically located within the inlet header 22 as shown or may be offset from the centerline thereof in order to enhance the ability of the inlet header 22 to provide uniform flow of two-phase refrigerant to the individual channels 24. A plurality of openings 36 are provided in the tube 34 for conducting the flow of refrigerant from the tube 34 to the inlet header 22 and hence to the individual microchannels 24. The size and shape of the openings 36 may be selectively varied in order to promote the uniform flow of refrigerant to the individual microchannels 24. Generally, the size of the openings 36 will increase from the inlet end 37 to the downstream end 38, for example as illustrated in FIGS. 5 and 6.

Although the number and location of the openings 36 may be varied as desired, the embodiment as shown in FIG. 3 provides a single opening 36 for each of the microchannels 24 such that the opening 36 is substantially longitudinally aligned with its respective microchannel 24.

Figure 3A:
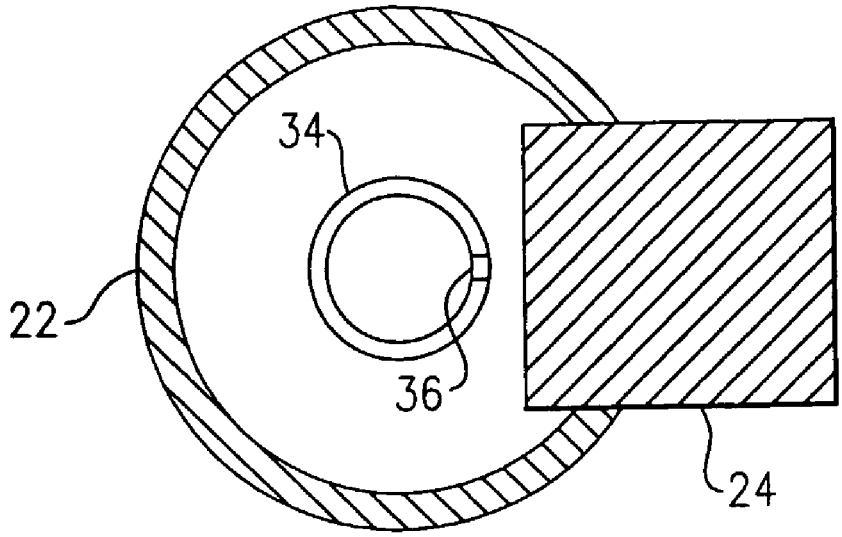
FIGS. 3A and 3B are alliterative transverse cross-section views thereof.
Figure 3B:
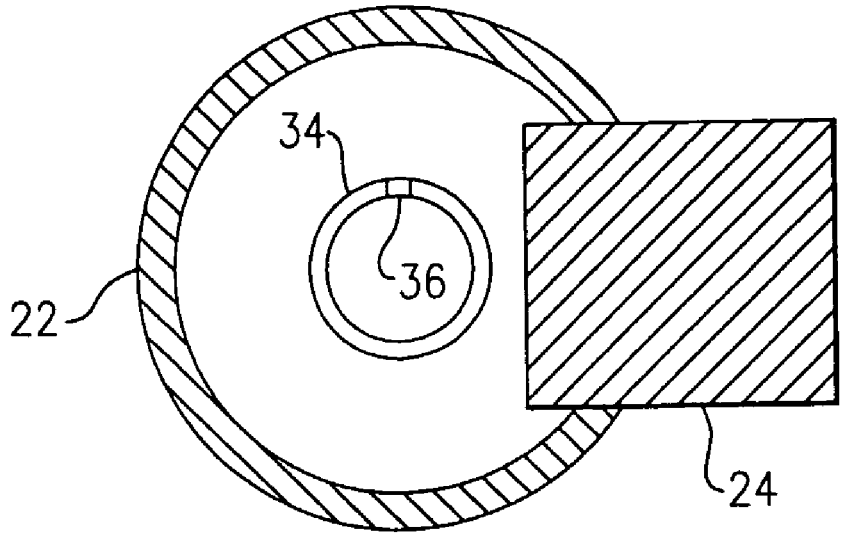

In addition to the possible size and shape of the openings 36 as discussed hereinabove, the angular orientation of the openings 36 with respect to the axes of the microchannels may be varied as desired in order to promote uniform flow distribution. That is, the openings 36 may be axially aligned with the microchannels 24 as shown in FIG. 3A, or they may be angularly offset in a manner such as shown in FIG. 3B. Such an angular offset of 90° has been found to be helpful in creating a desired mixing offset such that more uniform flow distribution occurs.

In accordance with the present invention the refrigerant is distributed in the liquid phase from the liquid line into an expansion device 39 that expands directly into the inlet end 37 of the perforated tube. In this way, all of the liquid refrigerant is first distributed to the microchannel slabs and then expanded to a two-phase state thus, eliminating the two-phase separation that occurs when expanding prior to distribution as described in respect to the prior art above. Further, there is no pressure drop that is associated with the feeder tubes of the prior art.

Figure 4:
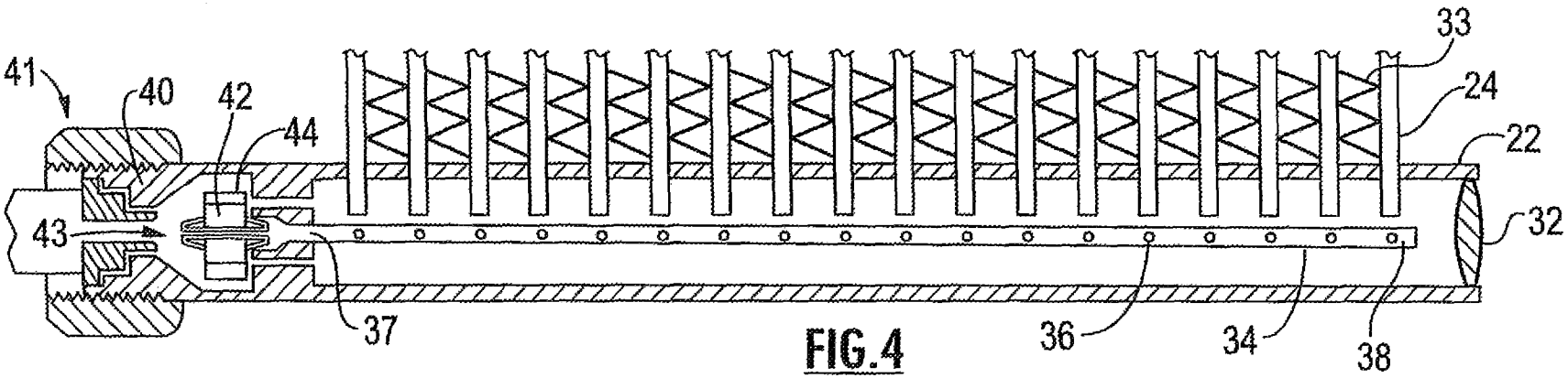
FIG. 4 is a longitudinal cross-section view thereof showing details of the expansion device thereof.

Referring now to FIG. 4, it will be seen that the expansion device 39 of FIG. 3 is comprised of a bi-flow piston assembly 41 having a body 40 that houses a floating piston 42, which is adapted to be in one of two extreme positions, depending on the direction of refrigerant flow. That is, for the cooling modes of operation, the heat exchanger is operated as an evaporator coil and the refrigerant flows into the inlet header, whereas during heating operation, the coil is operated as a condenser coil and the refrigerant is flowing from the same header which is now the outlet header of the condenser coil. The features of the piston 42 which allow for this bi-flow relationship are a central opening 43 and a plurality of peripheral flutes 44 as shown in FIG. 4.

As shown in FIG. 5, when the system is operating in a cooling mode, the refrigerant is flowing into the bi-flow piston assembly 41, and the piston 42 is to the far right with its flutes 44 resting against a shoulder of the body 40. The refrigerant then passes through the central opening 43 which acts as an expansion device such that two-phase refrigerant than flows into the tube 34 and then to the individual microchannels 24.

In the FIG. 6 embodiment, the flow of refrigerant is passing from the header and into the bi-flow piston assembly 41, such that the piston 42 is moved to the far left. In this position, the refrigerant is free to flow from the manifold 22 and between the flutes 44 to pass around a periphery of the piston 42. While the central opening 43 is still open, there is very little, if any refrigerant in the tube 34 since the refrigerant flow is most likely to travel by way of the least resistant path, directly from the manifold 22 and around the periphery of the piston 42.

We claim:

1. A parallel flow heat exchanger arrangement for a heat pump comprising:

a header defining in a cooling mode an inlet header, said inlet header having an inlet opening for conducting the flow of fluid into said inlet header and a plurality of outlet openings for conducting the flow of fluid from said inlet header;

a plurality of channels aligned in a substantially parallel relationship and fluidly connected to said plurality of outlet openings for conducting the flow of fluid from said inlet header;

a tube disposed within said inlet header and being fluidly connected at an inlet end to said inlet opening, said tube extending substantially the length of said inlet header and a having a plurality of openings formed therein for conducting the flow of refrigerant from said tube to said inlet header; and, a bi-flow piston assembly disposed at the inlet end of said tube, said piston assembly having a floating piston being adapted to selectively operate in response to the flow of refrigerant in a first position in a cooling mode condition to expand liquid refrigerant to a two-phase condition prior to entering said tube or in a second position in a heating mode condition to permit the flow of refrigerant directly from said header to said piston assembly without passing through said tube.

2. The parallel flow heat exchanger as set forth in claim 1 wherein said plurality of openings includes openings of different sizes.

3. The parallel flow heat exchanger as set forth in claim 2 wherein said differently sized openings are generally larger toward a downstream end of said tube.

4. The parallel flow heat exchanger as set forth in claim 1 wherein a number of said plurality of openings is substantially equal to the number of said plurality of channels.

5. The parallel flow heat exchanger as set forth in claim 4 wherein said plurality of openings have their respective axes aligned with the respective axes of said plurality of channels.

6. The parallel flow heat exchanger as set forth in claim 4 wherein said plurality of openings have their axes aligned substantially normal to the respective axes of said plurality of channels.

7. The parallel flow heat exchanger as set forth in claim 1 wherein said heat exchanger comprises an A-coil and includes:

a second header defining in a cooling mode condition a second inlet header, said second inlet header having an inlet opening for conducting the flow of fluid into said second inlet header and a second plurality of outlet openings for conducting the flow of fluid from said second inlet header;

a second plurality of channels aligned in substantial parallel relationship and fluidly connected to said second plurality of outlet openings for conducting the flow of fluid from said second inlet header;

a second tube disposed within second inlet header and being fluidly connected at an inlet end to an inlet opening, said second tube extending substantially the length of said second inlet header and having a second plurality of openings formed therein for conducting the flow of refrigerant from said second tube to said second inlet header; and, a second bi-flow piston assembly disposed at the inlet end of said second tube, said second piston assembly having a floating piston being adapted to selectively operate in response to the flow of refrigerant in a first position in a cooling mode condition to expand liquid refrigerant to a two-phase condition prior to its entering said tube or in a second position in a heating mode condition to permit the flow of refrigerant directly from said second header to said piston assembly without passing through said second tube.

8. A method of promoting uniform refrigerant flow from a header of a heat pump heat exchanger defining an inlet header during a cooling mode of operation to a plurality of parallel minichannels fluidly connected thereto, comprising the steps of:

forming a tube with an inlet end, a downstream end and a plurality of openings therebetween;

mounting said tube within said inlet header such that it extends substantially the length of said inlet header; to allow refrigerant to flow into said inlet end and through said tube and out of said plurality of openings into said inlet header prior to flowing into said plurality of parallel minichannels; and providing an piston assembly disposed at said inlet end of said tube, said piston assembly having a floating piston being adapted to operate in response to the flow of refrigerant in a first position during cooling mode operation to expand liquid refrigerant to a two-phase condition prior to entering said inlet header and to operate in a second position during heating mode operation to cause the refrigerant to flow directly from said header to said piston assembly without passing through said tube.

9. The method as set forth in claim 8 wherein said plurality of openings include openings of different sizes.

10. The method as set forth in claim 9 wherein said differently sized openings are generally larger toward a downstream end of said tube.

11. The method as set forth in claim 8 wherein the number of said plurality of openings is substantially equal to the number of said plurality of channels.

12. The method as set forth in claim 11 wherein said plurality of openings have their respective axes aligned with the respective axes of said plurality of channels.

13. The method as set forth in claim 11 wherein said plurality of openings have their axes aligned substantially normal to the respective axes of said plurality of channels.

14. The method as set forth in claim 8 wherein said heat exchanger comprises an A-coil and said method further includes:

providing a second header defining a second inlet header during a cooling mode of operation having an inlet opening for conducting the flow of fluid into said second inlet header and a second plurality of outlet openings for conducting the flow of fluid from said second inlet header;

providing a second plurality of channels aligned in substantial parallel relationship and fluidly connected to said second plurality of outlet openings for conducting the flow of fluid from said second inlet header;

providing a second tube having an inlet end, a downstream end and a second plurality of openings therebetween disposing said second tube within said second inlet header and being fluidly connected at the inlet end to said inlet opening, said second tube extending substantially the length of said second inlet header and having a second plurality of openings formed therein for conducting the flow of refrigerant from said second tube to said second inlet header; and providing a second piston assembly at the inlet end of said second tube, said second piston assembly having a floating piston being adapted to operate in response to the flow of refrigerant in a first position during cooling mode operation to expand liquid refrigerant to a two-phase condition prior to its entering said second tube and to operate in a second position during heating mode operation to cause the refrigerant to flow directly from said header to said expansion device without passing through said tube.

15. A parallel flow heat exchanger arrangement for a heat pump comprising:

a header defining in a cooling mode an inlet header, said inlet header having an inlet opening for conducting the flow of fluid into said inlet header and a plurality of outlet openings for conducting the flow of fluid from said inlet header;

a plurality of channels aligned in a substantially parallel relationship and fluidly connected to said plurality of outlet openings for conducting the flow of fluid from said inlet header;

a tube disposed within said inlet header and being fluidly connected at an inlet end to said inlet opening, said tube extending substantially the length of said inlet header and a having a plurality of openings formed therein for conducting the flow of refrigerant from said tube to said inlet header;

a bi-flow piston assembly having a body housing a floating piston, said floating piston adapted to be selectively positioned in response to refrigerant flow in a first position in a cooling mode condition and in a second position in a heating mode condition, said floating piston having a central opening, the central opening functioning as an expansion device in the cooling mode condition.

16. The parallel flow heat exchanger as set forth in claim 15 wherein said floating piston further includes a plurality of peripheral flutes defining flow passages around the periphery of said floating piston through which refrigerant is free to flow to pass from said header around said floating piston in a heating mode condition.

* * * * *